US010827856B2

(12) United States Patent
Millman et al.

(10) Patent No.: US 10,827,856 B2
(45) Date of Patent: Nov. 10, 2020

(54) IMAGE DISPLAY

(71) Applicant: Nations Photo Lab LLC, Hunt Valley, MD (US)

(72) Inventors: Ryan J. Millman, Hunt Valley, MD (US); Cheyne J. Smith, Westminster, MD (US)

(73) Assignee: Nations Photo Lab LLC, Hunt Valley, MD (US)

( * ) Notice: Subject to any disclaimer, the term of this patent is extended or adjusted under 35 U.S.C. 154(b) by 0 days.

(21) Appl. No.: 16/016,135

(22) Filed: Jun. 22, 2018

(65) Prior Publication Data

US 2019/0261789 A1 Aug. 29, 2019

Related U.S. Application Data

(60) Provisional application No. 62/636,282, filed on Feb. 28, 2018.

(51) Int. Cl.
*A47G 1/06* (2006.01)

(52) U.S. Cl.
CPC ..... *A47G 1/0633* (2013.01); *A47G 1/06* (2013.01); *A47G 2001/0677* (2013.01)

(58) Field of Classification Search
CPC .. A47G 1/0605; A47G 1/0611; A47G 1/0633; A47G 1/0638; A47G 1/2001; A47G 1/005; A47G 2001/0661; A47G 2001/0677
See application file for complete search history.

(56) References Cited

U.S. PATENT DOCUMENTS 2,762,148 A * 9/1956 Alcaraz ..... G09F 1/12 229/171
2,950,556 A * 8/1960 Larios ..... A47G 1/0633 40/788
3,286,387 A * 11/1966 Allan ..... A47G 1/0633 40/788
3,837,106 A * 9/1974 Lofstrom ..... B42F 17/18 40/124.2
3,883,975 A * 5/1975 Mentken ..... A47G 1/0605 40/741
4,120,074 A * 10/1978 Haber ..... A47G 1/143 16/257
4,283,870 A * 8/1981 Stetler ..... A47G 1/0605 40/780
5,042,180 A * 8/1991 Horiuchi ..... A47G 1/0611 40/788
8,851,307 B2 * 10/2014 Lefevre ..... A47B 96/062 108/108

(Continued)

*Primary Examiner* — David R Dunn
*Assistant Examiner* — Christopher E Veraa
(74) *Attorney, Agent, or Firm* — Sterne, Kessler, Goldstein & Fox P.L.L.C.

(57) ABSTRACT

Image displays are disclosed. An image display may include an image support and a plurality of foldable sections. Each foldable section may have a first segment rotatably coupled to and configured to lock with the image support and a second segment rotatably coupled to and configured to lock with the first segment. The image display may have an open and an assembled configuration. Display faces of the image support, first segment, and second segment may be co-planar in the collapsed configuration. The display faces image support and the second segment may be perpendicular to the display face of the first segment in the assembled configuration.

20 Claims, 12 Drawing Sheets

(56) References Cited

U.S. PATENT DOCUMENTS

| | | | | |
|---|---|---|---|---|
| 9,358,830 | B1 * | 6/2016 | McLaughlin | B44D 3/18 |
| 2014/0314971 | A1 * | 10/2014 | Domanski | B41M 5/508 428/32.18 |
| 2015/0265072 | A1 * | 9/2015 | Ridless | B41M 5/52 40/773 |
| 2015/0313382 | A1 * | 11/2015 | Skinner | A47G 1/0633 40/768 |
| 2016/0073797 | A1 * | 3/2016 | Morrish | A47G 1/0633 40/768 |
| 2016/0143461 | A1 * | 5/2016 | Millman | A47G 1/0633 40/786 |
| 2018/0000264 | A1 * | 1/2018 | Kerl | A47G 1/0633 |

* cited by examiner

IMAGE DISPLAY

CROSS-REFERENCE TO RELATED APPLICATIONS AND INCORPORATION BY REFERENCE

This application claims priority to U.S. Provisional Patent Application No. 62/636,282, filed on Feb. 28, 2018, which is incorporated herein in its entirety by reference thereto.

FIELD

The described embodiments relate generally to image displays.

SUMMARY

According to some embodiment, an image display includes an image support section. The image display may also include a plurality of foldable sections. Each foldable section may comprise a plurality of segments. In some embodiments, each foldable section may have first segment rotatably coupled to and configured to lock with the image support section and a second segment rotatably coupled to and configured to lock with the first segment. In some embodiments, the image display has a first configuration and a second configuration. The image support section, each of the first segments of the plurality of foldable section, and each of the second segments of the plurality of foldable sections are co-planar in the first configuration. In the second configuration, each of the first segments of the plurality of foldable sections, and each of the second segments of the plurality of foldable sections are non-planar. In the second configuration, each first segment of the plurality of foldable sections is locked to the image support section and the each second segment is locked to one of the first segments.

Each of the first segments of the image display assembly may be rectangular and each of the second segments of the image display assembly may be trapezoidal. According to some embodiments, a lattice structure may be formed on the image support. The lattice structure may increase the rigidity of the image display assembly.

Each of the first segment may be configured to lock with the image support using a snap fit connection. Additionally, each of the second segments may be configured to lock with one of the first segments using a snap fit connection.

In some embodiments, portions of the image display assembly are formed using an injection molding process. For example, the image support and the plurality of foldable sections may be made from an injection molding processing. According to some embodiments, the image display assembly may include an image medium. The image medium may wrap around the image support and the foldable sections. The image medium may be attached to portions of the image support or the foldable sections such that the image medium is pulled taut on the image display. In some embodiments, the image support may define a void. The image medium may stretch across this void.

An image display according to some embodiments includes a display assembly. The display assembly has an image support and a plurality of foldable sections. Each of the foldable sections may include a first segment rotatably coupled to and configured to lock with the image support. Each of the foldable sections may also have a second segment rotatably coupled to and configured to lock with the first segment. An image medium may be coupled to the display assembly. In some embodiments, the image medium may be coupled to one or more of the foldable sections. The image medium may be coupled to the second segment of the foldable sections.

In some embodiments, each first segment may be configured to lock with the image support when a first attachment angle is less than a first threshold angle. Each second segment may be configured to lock with the first segments when a second attachment angle is less than a second threshold angle. The first and second segments may be locked using snap fit connections. In some embodiments, the first and second segments may be releasably locked. When the first and second segments are locked, the image medium may wrap around the display assembly. The image display of claim 1, wherein the first segment is rotatably coupled to the image support by a living hinge, and wherein the second segment is rotatably coupled to the first segment by a living hinge.

According to some embodiments, one of the foldable sections is coupled to each side of the image support. The image medium may be coupled to the display assembly in a number of ways. For example, the image medium may have portions configured to mate with image medium supports on the display assembly. In some embodiments an adhesive may be applied to the display assembly. The image medium may be coupled to the display assembly by the adhesive. In some embodiments, the adhesive is applied to the foldable segments of the display assembly. In some embodiments, the adhesive is applied only to the foldable segments of the display assembly.

In some embodiments, the image display may have an open and an assembled configuration. In the collapsed configuration, the first segments may not be locked to the image support and the second segments may not be locked to the first segments. In the assembled configuration, the first segments are locked to the image support and the second segments are locked to the first segments.

In some embodiments where the image display has an open and an assembled configuration, the thickness of the image display in the collapsed configuration is less than the thickness of the image display in the assembled configuration. In some embodiments, the collapsed configuration thickness is less than half the thickness of the image display in the assembled configuration.

An image display according to some embodiments may be a modular image display assembly. The modular image display assembly may have an image support and a plural of sections coupled to the image support. Each of the plurality of sections may have a locked orientation relative to the image support. Each of the plurality of sections may not be rigidly coupled to the image support.

In some embodiments, an image display comprises an image support section and a plurality of foldable sections. Each foldable section may have a first segment rotatably coupled to and configured to lock with the image support section and a second segment rotatably coupled to and configured to lock with the first segment. In some embodiments, the image display includes an image medium coupled to at least one of the image support section and one of the plurality of foldable section.

In some embodiments, one of the plurality of foldable sections are coupled to exterior portions of the image support. Medium couplers may extend from the image display. Medium couplers may be configured to engage an image medium to secure the image medium to the image display. According to some embodiments, the image medium may be coupled to the image display without the use of adhesives.

According to some embodiments, the image display may have a collapsed configuration and an assembled configuration. In the assembled configuration, the first segment is locked with the image support and the second segment is locked with the first segment. According to some embodiments a thickness of the image display in the collapsed configuration is less than half a thickness of the image display in the assembled configuration.

A method of assembling an image display according to some embodiments may include coupling an image medium to a plurality of foldable section. Each foldable section may extend from an image support section. Each foldable section may be rotated relate to the image support section. Each foldable section may then be rotatably locked relative to the image support section.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
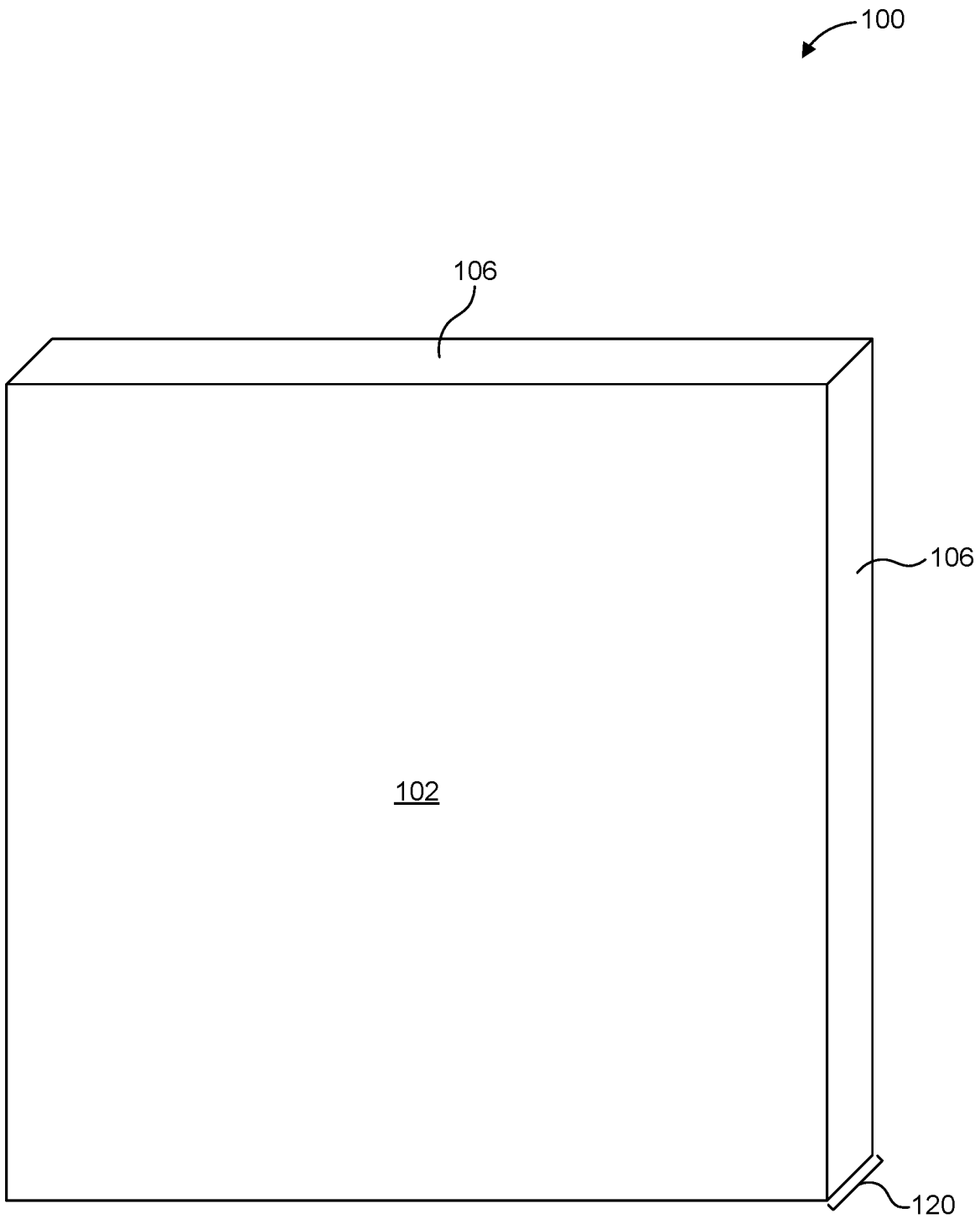
FIG. 1 shows an image display assembly in an assembled configuration.

Reference will now be made in detail to representative embodiments illustrated in the accompanying drawings. The following descriptions are not intended to limit the embodiments to one preferred embodiment. To the contrary, it is intended to cover alternatives, modifications, and equivalents as can be included within the spirit and scope of the described embodiments as defined by the claims.

The present disclosure is directed to image displays that are used to display images. According to some embodiments, the displayed image is on an image medium that is coupled to the image display. However, in some embodiments, the displayed image is formed, e.g., printed or painted directly on the image display itself. The image medium may be paper, canvas, or materials on which an image may be formed. For example, photographs printed on photo paper or images printed on canvas are types of image mediums. According to some embodiments, an image display may be plastic and formed of injection molded components. The image display may be formed of a single injection molded piece, or of multiple pieces that are operatively coupled. The image display may have a surface or multiple surfaces to display one or more image mediums.

A "gallery wrap," such as a canvas wrap, is a style of image display. The gallery wrap style is characterized by the image medium wrapping around portions of the image display. Often, the image medium extends across the front surface and side surfaces of the image display and is secured to the back surface of the image display. The gallery wrap image display presents a frameless display of the image to the viewer. A rectangular gallery wrap image display with an image medium is used as an example. In this example, the image medium extends beyond the front surface of the gallery wrap image display, and the portions of the image medium extending rearward beyond the front face of the image display wrap around the side surfaces, e.g., top, bottom, left, and right surfaces, of the display and are attached to the back of the display. The image medium may be attached to the back of the gallery wrap image display using staples, adhesives, or other means.

The distinctive wrapping of a gallery wrap image display makes thicker image displays desirable because the thickness enhances the visual appearance of the frame and accentuates the wrapped nature of the image medium. The thickness of a typical gallery-wrap image display is at least 0.75 inches. For example, a typical gallery wrap display may be three-quarters to four inches thick. Some larger gallery wrap image displays may be more than four inches thick. While the increased thickness of the gallery wrap image display contributes to its distinctive look, this thickness can also increase manufacturing and shipping costs.

Manufacturing a gallery wrap image display requires manufacturers to smoothly wrap and attach the image medium to the image display. A small mistake in attaching the image medium to the gallery wrap image support may result in a wrinkled or distorted image medium. Thus, manufacturers may carefully wrap the image medium around the image support, for example, a frame. This can add time and, thus, costs to the manufacturing process. Additionally, the skills required to properly manufacture a gallery wrap image display may discourage some vendors from offering custom images, such as family photographs provided by a customer, on gallery wrap image displays. The training costs or potential for product waste due to manufacturing error may discourage vendors from selling gallery wrap image displays.

Some vendors offering custom images on gallery wrap image displays may ship the product directly to the customer from a central location. The gallery wrap image display's thickness can increase the shipping costs. The thickness of gallery wrap image displays means that boxes, which typically have a higher shipping costs than envelope mailers, are necessary so ship gallery wrap image displays. Even small gallery wrap image displays are often too thick to ship in containers other than boxes. Vendors may desire to ship some gallery wrap image displays in envelope mailers, such as, for example, a Flat Rate Envelope. Flat Rate Envelopes, such as those offered by the United States Postal Service, give vendors more cost predictability when selling a gallery wrap image display. Additionally, image displays according to some embodiments can be shipped in bulk. Because of the collapsed nature, more image displays according to some embodiments may be packed in a single shipping container than traditional gallery wraps. Not only does this contribute to reduced shipping costs, but it also gives image display a smaller foot print in a retail setting. The smaller foot print may mean that more vendors would be willing to sell custom prints on gallery wrap image displays because the image displays take up less space in the store.

Finally, the manufacturing needs of producing a quality gallery wrap image display makes changing image mediums on the image display costly and time consuming. A consumer wishing to change an image medium on an image display must remove the old image and then carefully attach a new image to the image display to ensure that no wrinkles or other distortions are present in the image medium. In some situations, it is more convenient for the customer to order a new image display with a custom image from a vendor. The old image display with the old image medium is disposed of.

The present disclosure is directed to an image display. The image display has a first collapsed configuration and a second assembled configuration. At least a portion of the image medium is coupled to an image support of the image display. In some embodiments, the image medium wraps around the image display support in the assembled configuration. Some embodiments of the disclosed image displays may be described as gallery wrap image displays. In the assembled configuration, some embodiments may have an assembled thickness similar to those of traditional gallery wraps. In the assembled configuration, the image displays disclosed herein have a thickness less than their assembled thickness. For example, an image display according to the present invention may have an assembled thickness at least double that of the thickness of the image display in the collapsed configuration. The image display may be shipped in the collapsed configuration. This reduces the thickness of the image display relative to the assembled configuration and reduces the cost of mailing the image display. Additionally, the reduced thickness may make storing the image display easier and requires less space.

Methods of mounting an image medium to an image display may utilize the collapsed and assembled configurations of the image display. According to some embodiments, the image medium may be mounted to medium couplers on foldable section of the image display in the collapsed configuration. When the image display is in the assembled configuration, the image medium is pulled taught across the image display via the medium couplers. In this way, the image medium is coupled to the image display without the use of adhesives or staples. The image medium may have voids or other points configured to mate with medium couplers on the image display, securing the image medium to the image display.

FIG. 1 shows an image display 100 in the assembled configuration according to some embodiments. Image display 100 has an image support 102. Image support 102 may be substantially planar and may have a variety of shapes when viewed from the front. For example, image support 102 may be a rectangle (which includes a square), hexagon, regular polygon, or an irregular polygon. As shown in FIG. 1, image support 102 is substantially planar. In some embodiments, image support 102 may not be planar. For example, image support 102 may be curved. An image medium 150 may be mounted on or extend across a front surface of image support 102. Image support 102 can be solid surface or may have one or more voids formed in the surface. For example, image support 102 may be generally rectangular and have a generally rectangular void formed in the center of image support 102. A rectangular perimeter of image support 102 defines the void in the center of image support 102. Image medium 150 may extend across the void to the perimeter portions of image support 102, thereby covering the void. These void(s) allow image support 102 to be manufactured with less material, thereby decreasing the manufacturing cost of the image display 100.

Image display 100 may have an assembled thickness 120. As shown in FIG. 1, assembled image display 100 has an assembled thickness 120. Assembled thickness 120 may also be called the depth of image display 100. The assembled thickness 120 is defined by the front-most edge of image display 100 and the back-most edge of image display 100. According to some embodiments, assembled thickness 120 may be uniform for an image display 100. Image display 100 may also have an collapsed thickness 122 in the collapsed configuration of image display 100. Collapsed thickness 122 is less than assembled thickness 120. Collapsed thickness 122 may be at least one half assembled thickness 120. For example, collapsed thickness 122 may be one third or one quarter of the assembled thickness 120. For example, assembled thickness 120 may be 0.75 inches, and the collapsed thickness 122 may be 0.25 inches. In some embodiments, collapsed thickness 122 may be 0.25 inches or less. FIG. 1 shows assembled thickness 120 and FIG. 2 shows collapsed thickness 122.

Figure 2:
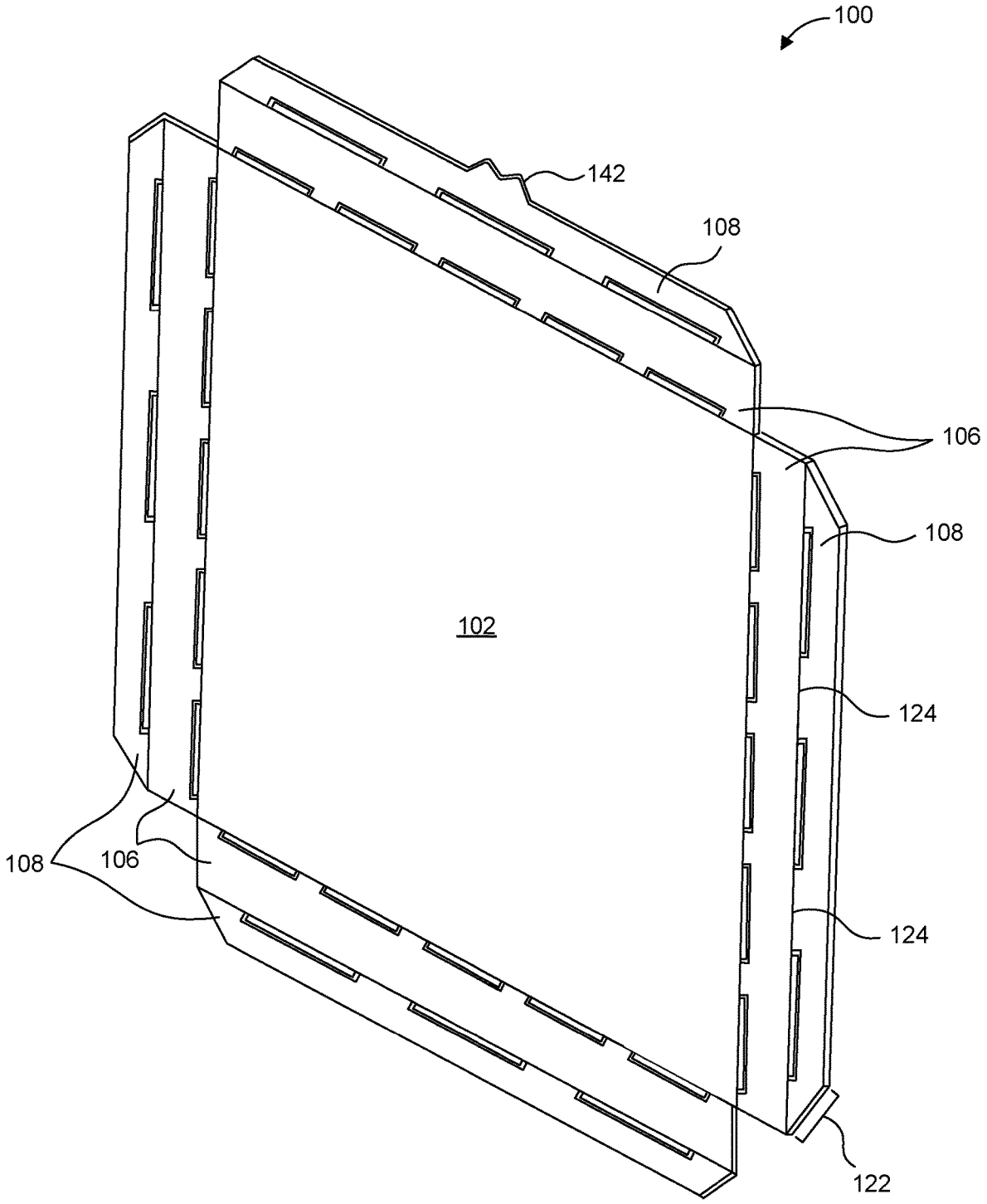
FIG. 2 shows an image display assembly in a collapsed configuration.

FIG. 2 shows a perspective view of an image display 100 in the collapsed configuration according to one embodiment. Image display 100 has one or more foldable sections 104 extending from sides of image support 102. As shown in FIG. 2, foldable sections 104 can have two segments—a first segment 106 and a second segment 108. Though shown with two segments in FIG. 2, foldable sections 104 can have more or fewer segments. Foldable sections 104 may be coupled to image support 102 a variety of ways. For example, foldable sections 104 may be coupled to image support 102 by hinges, snap fit connections, or other attachment mechanisms. In some embodiments, foldable sections 104 may be separate from image support 102 in the collapsed configuration. According to some embodiments foldable sections 104 may be removably coupled to image support 102. Once a customer receives image support 102, the customer may couple foldable sections 104 to image support 102. For example, foldable sections 104 may be coupled to image support 102 using a snap fit connection. The snap fit connection may be removable such that an assembled image display 100 may be collapsed or disassembled. For example, an assembled image display 100 may be opened or disassembled for transport and then reassembled at a destination.

In other embodiments, foldable sections 104 may also be coupled to image support 102 by an flexible sheet, separate from image support 102 and foldable sections 104, extending between image support 102 and foldable sections 104. The sheet may act as a living hinge between image support 102 and foldable sections 104 such that foldable sections can rotate relative image support 102.

In other embodiments, foldable sections 104 may be coupled to image support 102 by one or more living hinge integrally formed with image support 102 and foldable sections 104. The living hinge(s) would extend between image support 102 and foldable sections 104. Similarly, second segments 108 can be rotatably coupled to first segments 106 via any one of the above described embodiments for coupling first segments 106 to image support 102.

Image display 100 may also have a hanger support 142 coupled to one or more of foldable sections 104. Hanger support 142 may allow a customer to conveniently hang image display 100 in the assembled configuration. Hanger support 142 may extend from foldable sections 104 and be configured to engage a hook or other support extending from a wall on which image display 100 will hang. In some embodiments, the hanger support 142 is configured to engage a hook or other support extending from a wall at a recess or void in hanger support 142. The hook or other support extending from the wall may pass through the recess or into the void and engage hanger support 142 such that image display 100 may hang by hanger support 142. In some embodiments, hanger support 142 is coupled to or integral with one second segment 108 of the plurality of foldable sections 104.

Figure 3:
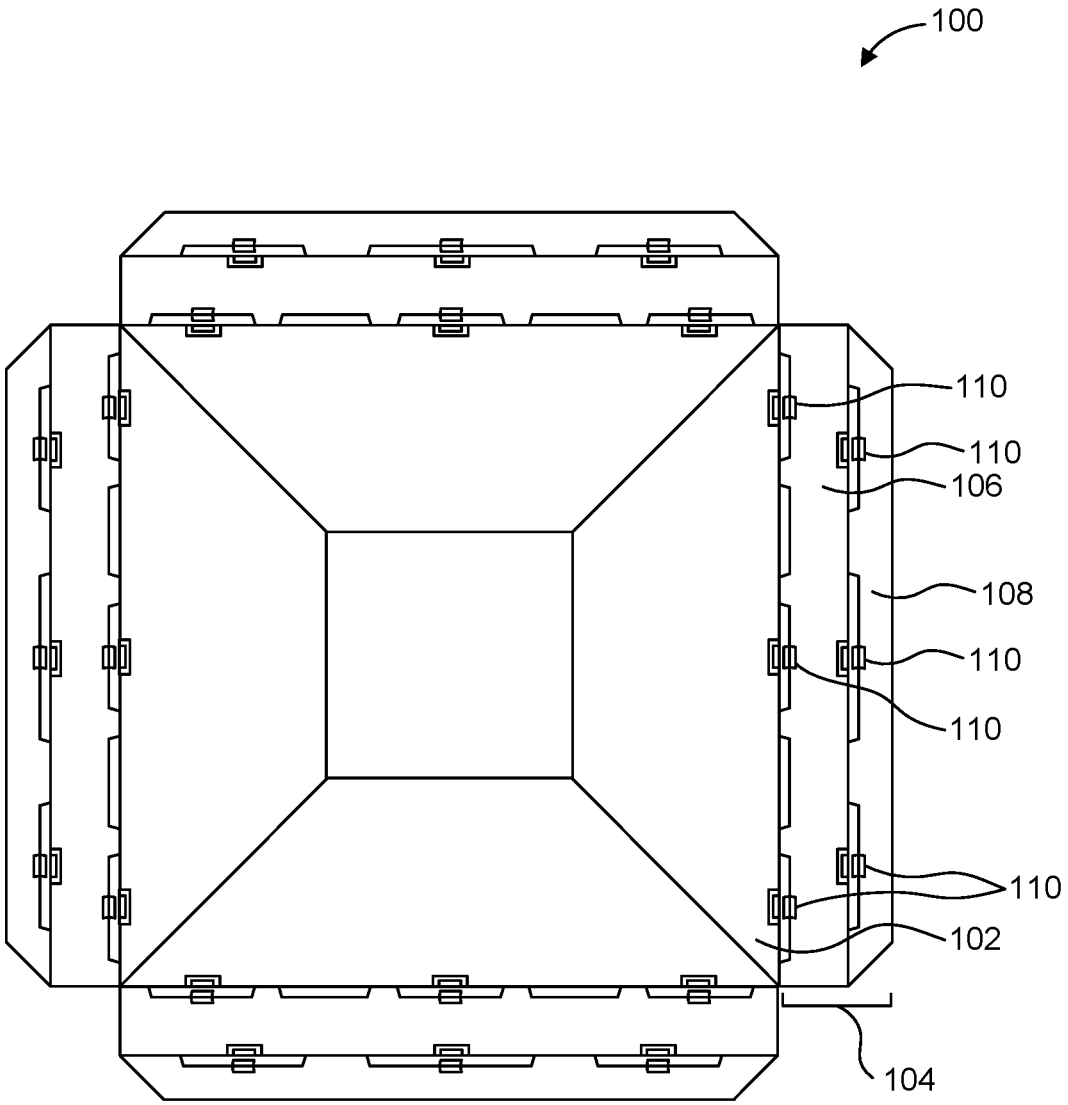
FIG. 3 shows a front view of the image display assembly of FIG. 2.

As shown in FIG. 3, first segments 106 of foldable sections 104 may be coupled to image support 102 by hinges 124. Hinges 124 permit first segments 106 to rotate relative to image support 102. For example, hinges 124 permit first segments 106 to rotate 90 degrees relative to image support 102. A second segment 108 of foldable sections 104 may be coupled to each of first segments 106. As shown in FIG. 3, second segments 108 are also coupled to first segments 106 by hinges 124. However, second segments 108 may also be coupled to first segments 106 in a number of rotatable and non-rotatable ways such as, for example, by an adhesive or snap fit connection. Hinges 124 permit the rotation of second segments 108 relative to first segments 106. In some embodiments, hinges 124 may be a living hinge.

Segments of foldable sections 104 may have various shapes. In some embodiments, the shape facilitates visually appealing mating between adjacent segments or adjacent foldable sections 104. For example, as shown in FIG. 3, second segments 108 have a trapezoidal shape and have angled corners 128. When assembled, angled corners 128 of adjacent second segments 108 meet.

Image display 100 may display an image medium 150. Image medium 150 may be any medium having an image, for example, a photograph, illustration, painting, drawing, or the like. Image medium 150 may be made of paper, canvas, plastic, metal, or other materials. Image medium 150 can be a resilient material with a degree of flexibility, for example, canvas. Image medium 150 may be coupled to image display 100 in a variety of ways. For example, image medium 150 may be adhered or to image display 100 using an adhesive material. In some embodiments, image medium 150 may be configured to receive an image on one side and having an adhesive on the other side. In some embodiments, the adhesive may be covered by a peel away paper. The peel away paper covering the adhesive may be removed after the image is printed on image medium 150 so that image medium 150 can then be adhered to a portion of image display 100, for example, image support 102.

Figure 4:
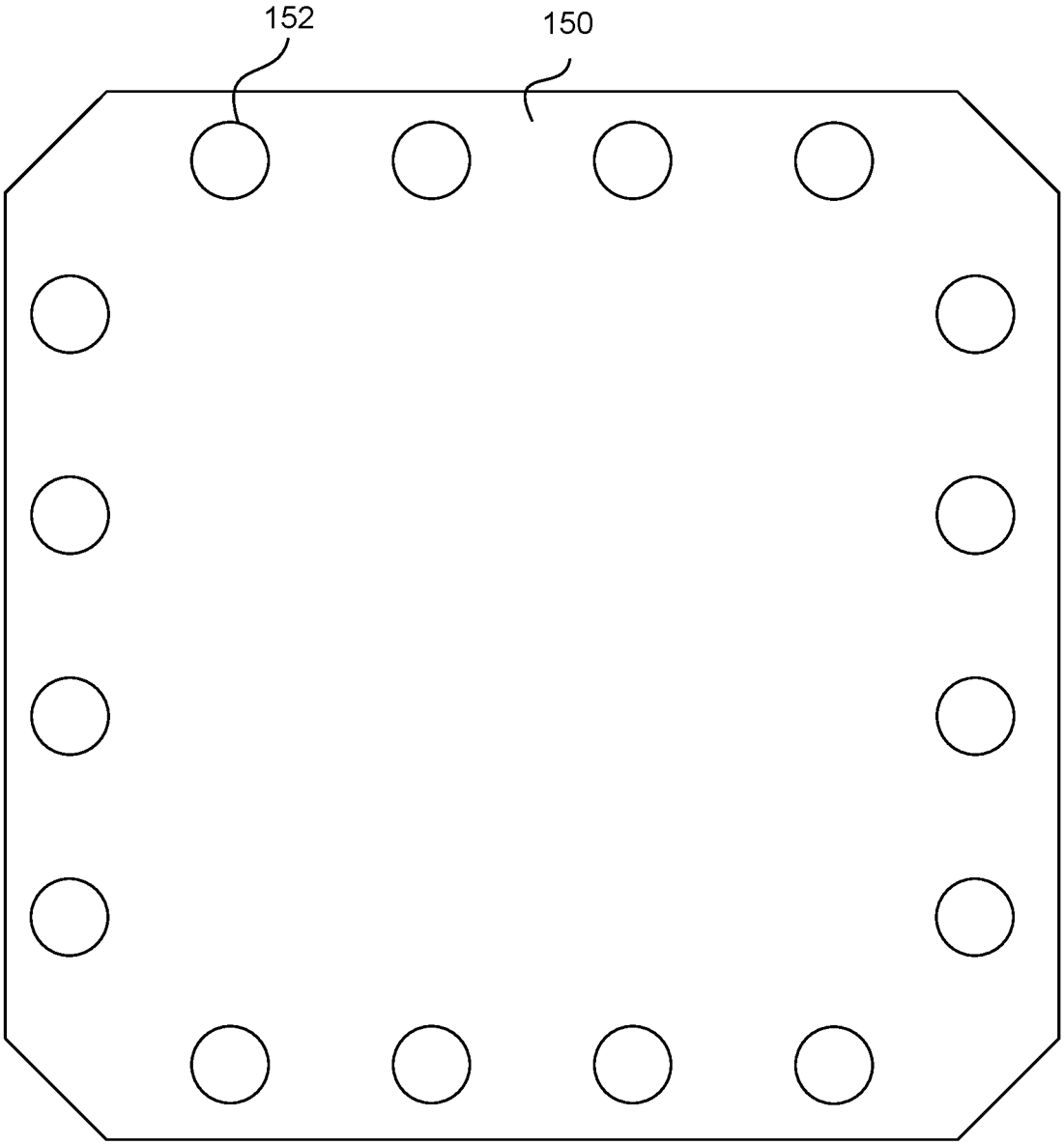
FIG. 4 shows a front view of an image medium.

A portion of image medium 150, in addition to or alternatively to a portion coupled to image support 102, may also be coupled to the foldable sections 104. In some embodiments, image medium 150 may have preformed voids 152 or other structured that are configured to mate with corresponding portions of image display 100. FIG. 4 shows image medium 150 according to some embodiments. As shown, image medium 150 has voids 152 configured to mate with medium couplers 140 on image display 100. Voids 152 may be formed in image medium 150 before an image is printed on image medium. In some embodiments, voids 152 may be formed after an image is printed on image medium 150. In this way, image medium 150 may be coupled to image display 100 without the use of adhesives or staples. According to some embodiments, image mediums 150 may be quickly coupled to image display 100. This configuration also allows for quickly interchange of a different image medium 150 on the same image display 100. Also, using no adhesive or staples may allow image mediums 150 to be reusable.

In some embodiments, image medium 150 is coupled to image display 100 in the collapsed configuration. In some embodiments, image medium 150 is coupled to image display 100 in the assembled configuration. When image medium 150 is coupled to image display 100 in the collapsed configuration, image medium 150 is stretched across image display 100 as image display 100 is arranged in the assembled configuration. In some embodiments image display 100 with image medium 150 can be assembled without the use of adhesives or stables. For example, medium couplers 140 may extend from foldable sections 104 and be configured to extend into voids 152 in image medium 150. Voids 152 may be formed with a press sized to precisely locate voids in image medium 150—the location of voids 152 corresponds to the location of respective medium couplers 150. In some embodiments, medium couplers 140 are injection molded pieces integrally formed on foldable sections 104. In some embodiments, medium couplers 140 may be a separate piece that attached to foldable sections 104 to couple image medium 150 to image display 100. Medium couplers 140 and voids 152 may be configured such that aligning voids 152 of image medium 150 with medium couplers 140 on image display 100 centers image medium 150 on image display 100. This enables image medium 150 to be mounted on image display 100 more quickly and produces a consistent quality gallery wrap.

In some embodiments, medium couplers 140 may also be clamping members. Clamping members may pierce image medium 150 and are configured to mate with portions of image display 100. For example, clamping members may be a separate piece having protrusions configured to punch through a perimeter of image medium 150 located on foldable sections 104. The clamping members hold image medium 150 in place on foldable sections 104.

Figure 11:
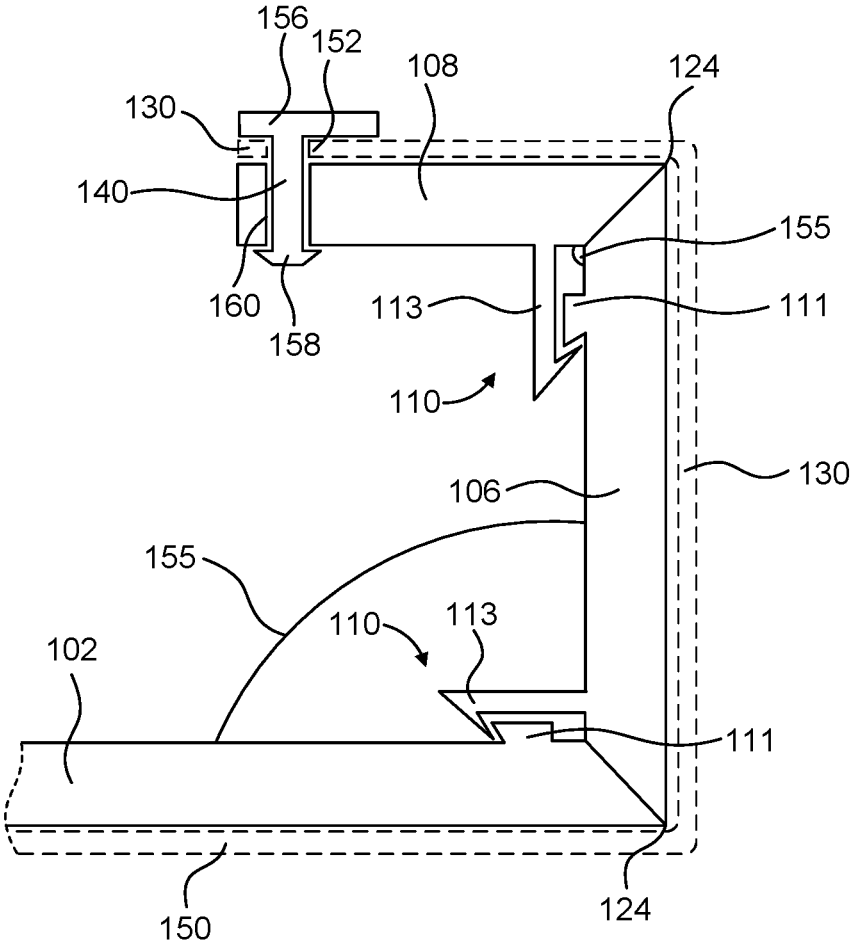
FIG. 11 shows a partial cross-sectional of an image display assembly having a coupling plate according to one embodiment.
Figure 12:
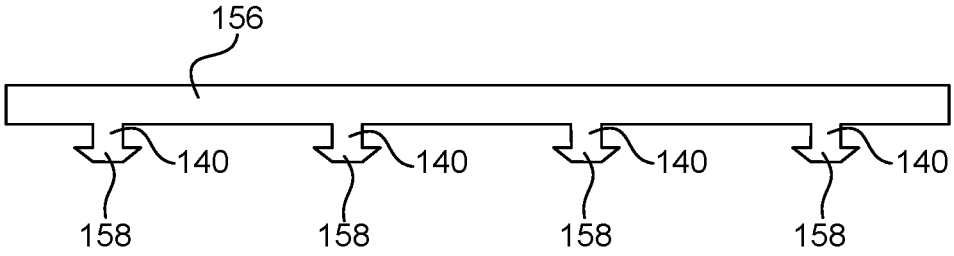
FIG. 12 shows a side view of a coupling plate used to couple the image medium to the image display according to one embodiment.
Figure 13:
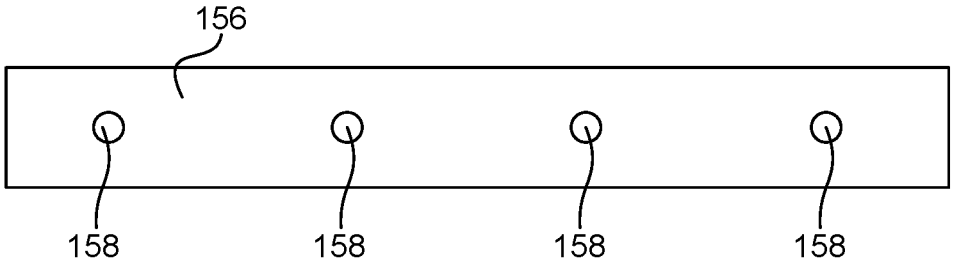
FIG. 13 shows a plan view of the coupling plate of FIG. 12 according to one embodiment.

FIGS. 11-13 illustrate an another embodiment for attaching image medium 130 to image display 100. In the illustrated embodiment, medium couplers 140 are disposed on one or more coupling plates 156 configured to secured to respective portions of foldable sections 104. For example, image display 100 can include a plate 156 for each second segment 108 of foldable sections 104. As best seen in FIG. 11, medium coupler 140 extends from plate 150, and includes a clasp 158 at the distal end. Second segment 108 defines a void 156 configured to receive coupler 140. Clasp 158 is configured to create an interference or friction fit with second segment 108, thereby securing coupling plate 156 to second segment 108. To secure portion of image medium 130 to image display 100 using a coupling plate 156, voids 152 on image medium 130 are aligned with voids 156 defined by second segment 108. Couplers 140 on coupling plate 156 are then aligned with voids 152 (and voids 156), and inserted within voids 156, until clasps 158 engage (for example, via a snap fit) second segment 108, thereby securing coupling plate 150 and image medium 130 to second segment 108, and thus, to image display 100. The image medium 130 is interposed between coupling plate 156 and second segment 108, and the insertion of coupling member 140 through void 152 in image medium 130 prevents image medium 130 from being pulled out from between coupling plate 156 and second segment 108.

FIGS. 12 and 13 illustrate side and plan views of coupling plate 156 according to an embodiment. Although FIGS. 12 and 13 illustrate coupling plate 156 with four couplers 140. Coupling plate 156 can include less than or more than four couplers 140.

In some embodiments, there is a coupling plate 156 for each edge of image medium 130. In some embodiments, each coupling plate 156 runs along substantially the entire length of the respective second segment 108. In other embodiments, each coupling plate 156 runs along only a portion of the length of the respective second segment 108.

Figure 5:
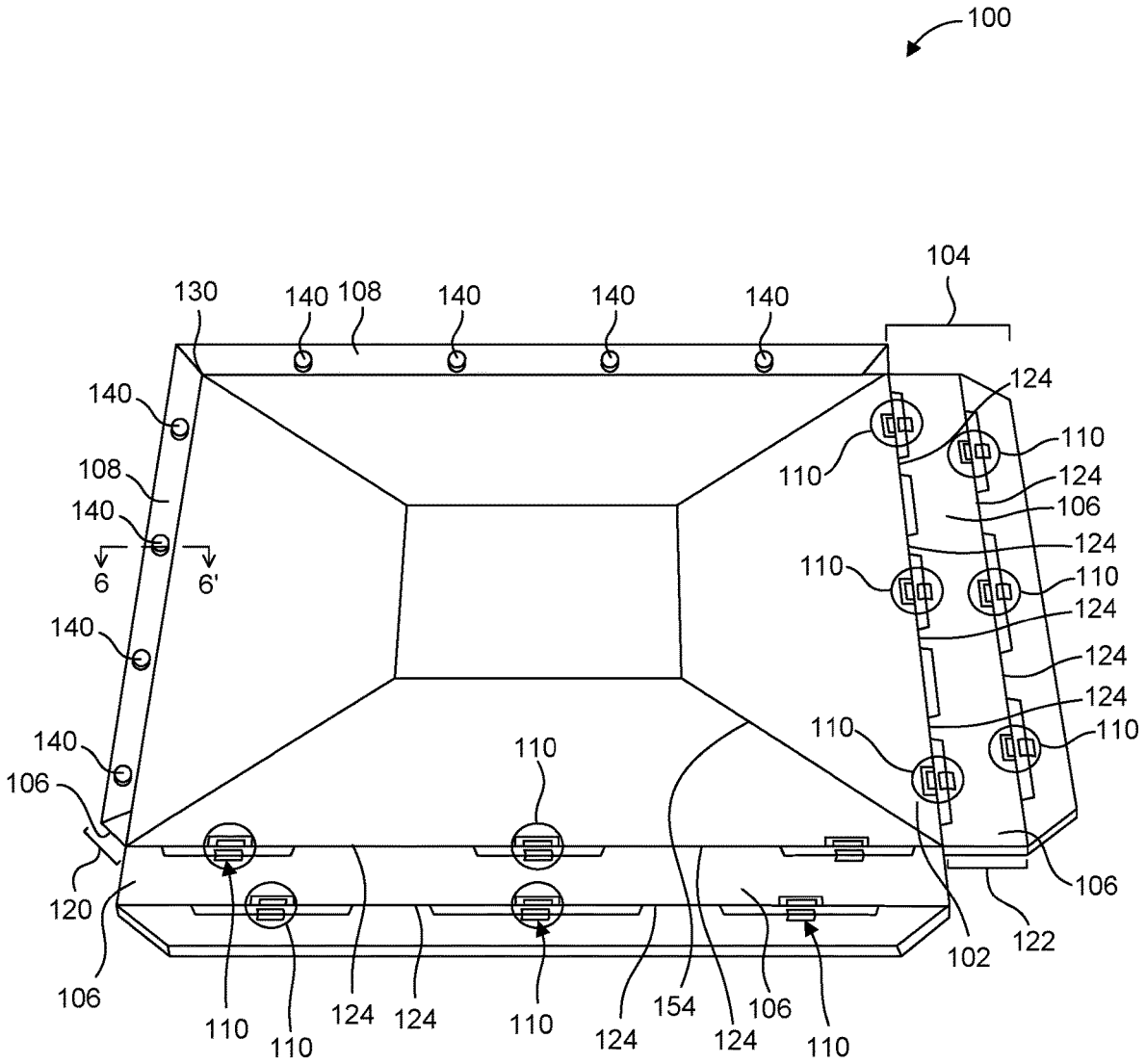
FIG. 5 shows a back top perspective view of an image display assembly in a partially assembled configuration.

According to some embodiments, the relative positions of image support 102 and foldable sections 104 of image display 100 may be maintained in the assembled configuration using locking mechanisms 110. For example, locking mechanisms 110 may secure foldable sections 104 to image support 102. Locking mechanisms 110 may also secure segments of foldable sections 104 to each other. For example, locking mechanisms 110 may secure second segments 108 to first segments 106, thereby maintain the relative position of each. Locking mechanisms 110 may lock portions of image display 100 thereby restricting rotation after the corresponding portions are locked together. For example, first segments 106 may be coupled to image support 102 by hinges 124. Locking mechanisms 110 may rotatably lock first segments 106 to image support 102 such that first segments 106 no longer rotates about hinges 124. Thus, locking mechanisms 110 fix the orientation of first segments 106 to image support 102. Locking mechanisms 110 on image support 102 and locking mechanisms 110 on first segments 106 are configured to operatively engage each other when folding sections 104 are assembled into the assembled configuration of the image display 100. Locking mechanisms 110 may be any type of lock. For example, as shown in FIG. 5, locking mechanism 110 may be a snap fit connector or any other type of interference fit connector. In other embodiments, locking mechanism 110 may by a friction fit connector. In some embodiments, locking mechanism 110 is made of two separate components on different portions of image display 100. These two portions of locking mechanism 110 mate to rotatably lock the two portions together. Image display 100 may also include locking mechanisms 110 that also rotatably lock first segments 106 and second segments 108 to each other. For example, locking mechanisms 110 on first segments 106 and locking mechanisms 110 on second segments 108 are configured to operatively engage each other when folding sections 104 are assembled into the assembled configuration of image display 100.

Figure 6:
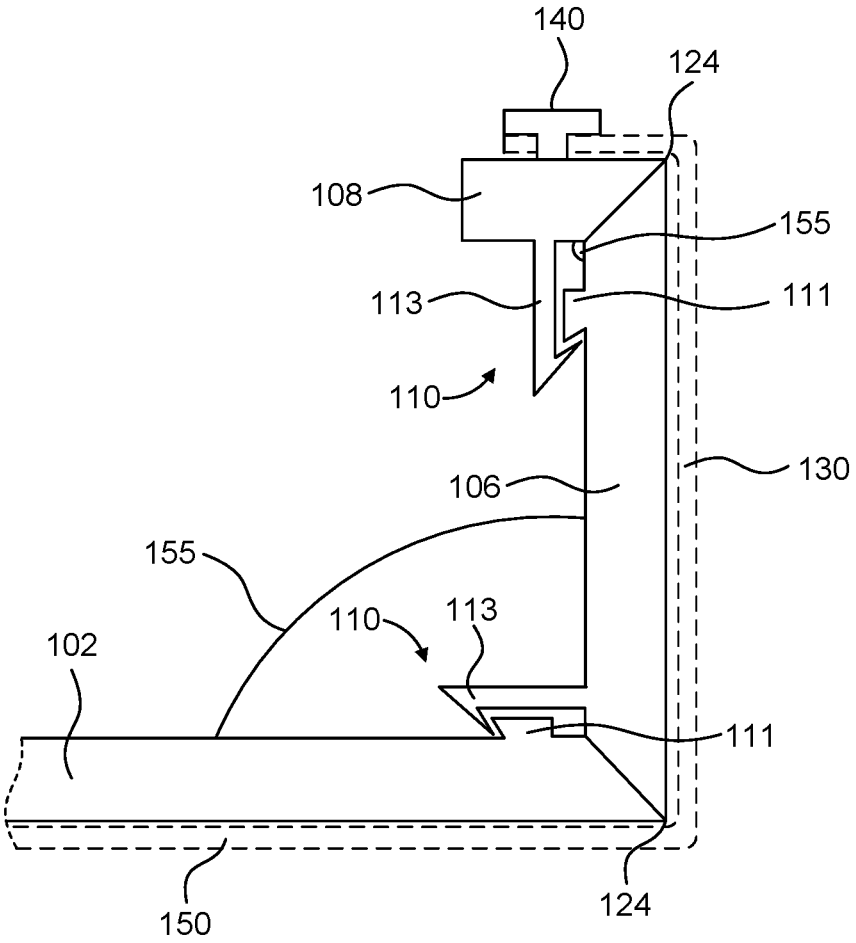
FIG. 6 shows a partial cross-sectional of an image display assembly taken at the line 6-6'.

FIG. 5 shows a rear perspective view of image display 100 in the partially assembly configuration. As shown in FIG. 5, image display 100 may include a reinforcing structure 154 that extends across portions of image display 100. Reinforcing structure 154 may increase the rigidity of portions of image display 100. Reinforcing structure 154 may be a plurality of ribs forming a lattice structure, such as that shown in FIG. 5. FIG. 5 shows second segments 106 forming corner 130 of image display 100. FIG. 6 shows a partial cross-sectional view of image display 100 taken at along line 6-6' in FIG. 5.

According to some embodiments, image display 100 may be assembled by rotating foldable sections 104 about hinges 124 to lock with image support 102 (i.e., operatively engaging locking mechanisms 110 on portions of foldable sections 104 with corresponding locking mechanisms 110 on image support 102) and to lock segments of foldable sections 104 to each other (i.e., operatively engaging locking mechanisms 110 on one segment of foldable sections 104 with corresponding locking mechanisms 110 on another segment of foldable sections 104). To assembly image display 100 into the assembled configuration (as shown, for example, in FIG. 6), first segments 106 are rotated relative to image support 102 such that locking mechanisms 110 on first segments 106 operatively engage corresponding locking mechanisms 110 on image support 102, thereby locking the position of first segments 106 relative to image support 102. FIG. 6 shows a locking mechanism 110 as a snap fit connector. The snap fit connector has a clasp 113 and a clasp mount 111. Clasp 113 extends from first segments 106 and is configured to lock with clasp mount 111 extending from image support 102. Similarly, clasp 113 extends from second segments 108 and is configured to lock with clasp mount 111 extending from first segments 106 when second segments 108 is rotated about hinges 124.

Locking mechanisms 110 lock second segments 108 to first segments 106 at a locking angle 155. Locking angle 155 may be a variety of angles. Locking angle 155 may also be variable using a locking ratchet system. For example, connecting clasp 113 to a first notch in clasp mount 111 may lock two segments at an angle of 45 degrees. Advancing clasp 113 to a second notch in clasp mount may lock the two segments at a 90 degree angle. And a third notch may allow the two segments to be locked at an angle of 120 degrees. The same is true for the angle relationship between foldable sections 104 and image support 102. FIG. 6 shows locking mechanisms 110 locking segments at a locking angle 155 of 90 degrees.

Figure 7:
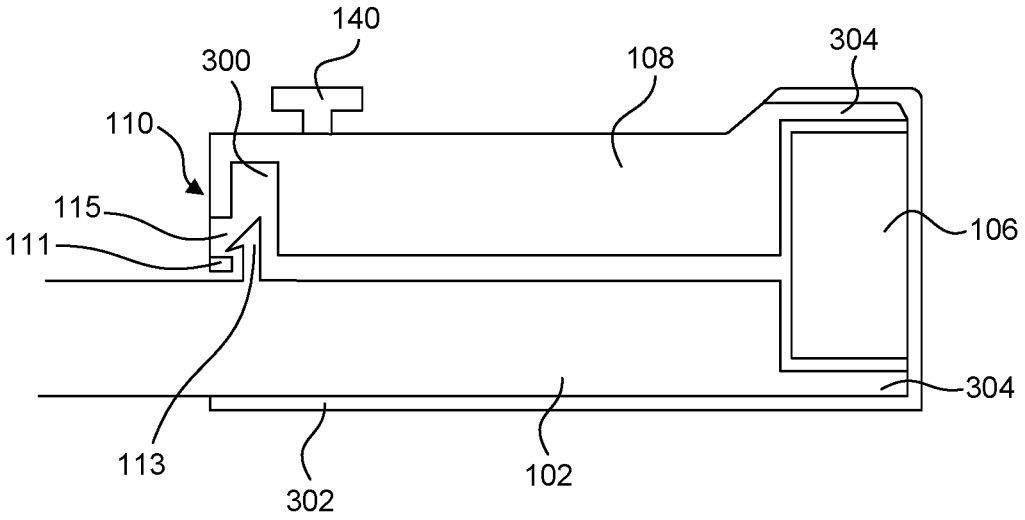
FIG. 7 shows a partial cross-sectional of an image display assembly according to one embodiment.
Figure 8:
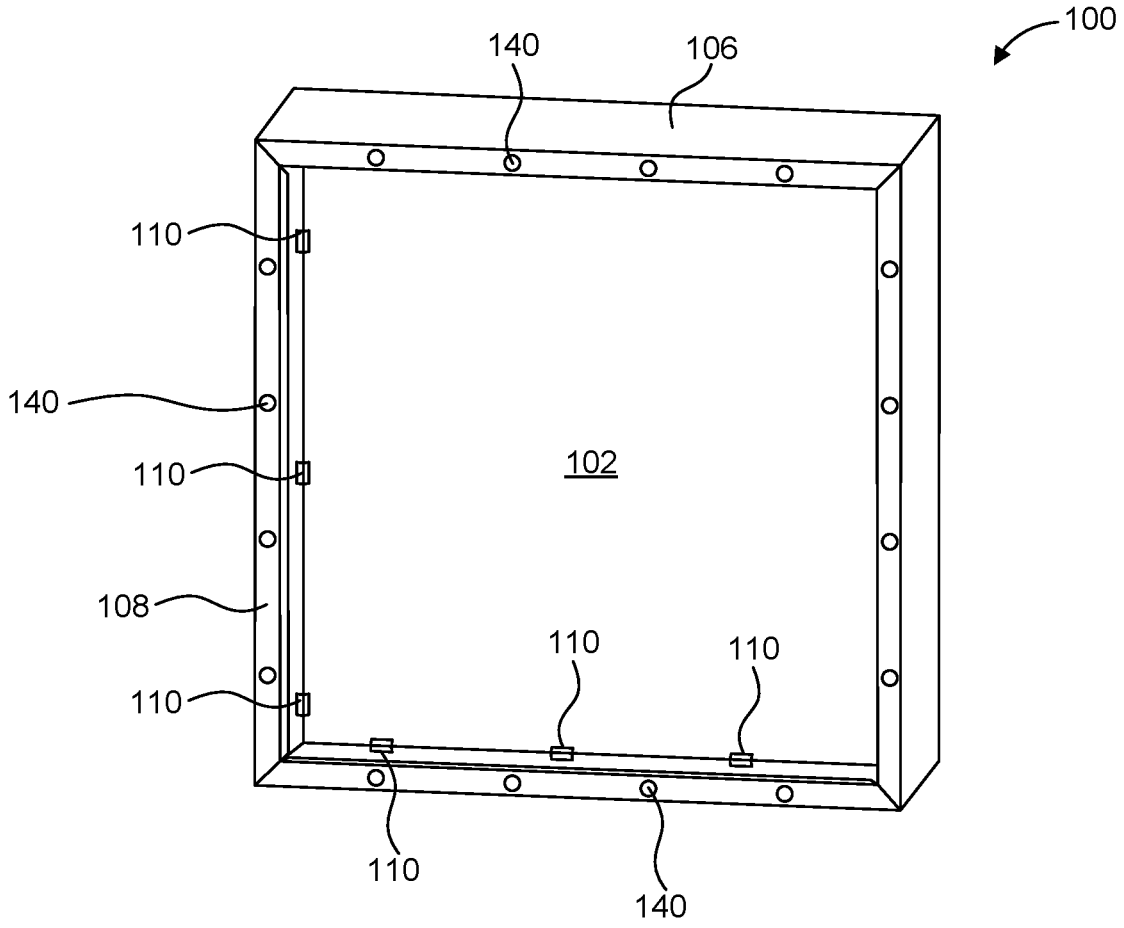
FIG. 8 shows a back perspective view of an assembled image display assembly.

In some embodiments of image display 100, image support 102 may be coupled to second segments 108. For example, as shown in FIG. 7 a partial cross section of an image display 100, according to an embodiment, where image support 102 may be coupled to second segments 108. In these and other embodiments, a void 115 may be located in second segments 108 through which connecting clasp may pass to engage clasp mount 111. In embodiments like the one shown in FIG. 7, a flexible member 302 may couple image support 102 to first segments 106, and first segments 106 to second segments 108. Flexible member 302 acts as a living hinge around which first segments 106 can rotate relative to image support 102, and second segments 108 can rotate relative to first segments 106. Flexible member 302 can be, for example, a flexible, polymeric sheet adhered to the surfaces of support 102, first segments 106, and second segments 108 as shown in FIG. 7. In some embodiments, flexible member 302 may be replaced with other types of hinges, for example, hinges 124 described elsewhere in this application. FIG. 7 also shows protruding members 304 which extend from image support 102 and second segments 108. Protruding members 304 may aid in aligning image display 100's components when folded into the assembled configuration.

Figure 9:
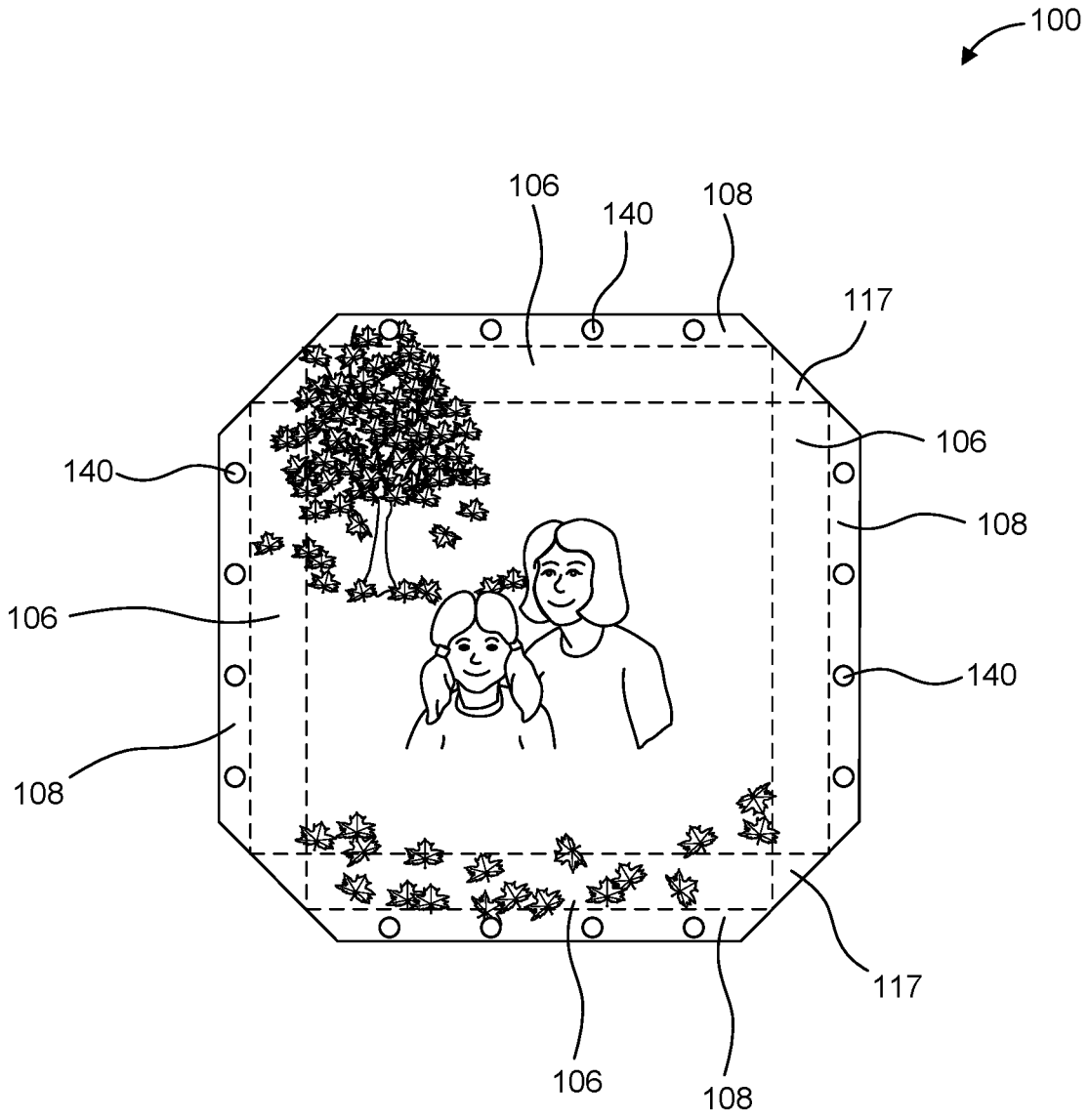
FIG. 9 shows a front view of image medium on an image display in the collapsed configuration.

FIG. 9 shows an image medium 150 mounted to image display 100. To assemble an image display 100 with image medium 150, a user may overlay image medium 150 on image display 100 in the collapsed configuration. Voids 152 of image medium 150 are aligned with medium couplers 140 such that one or more medium couplers extend through voids 152. Once image medium 150 located on image display 100, foldable sections 104 may be folded in to the assembled configuration. During the assembly process, the image medium 150 is stretched across image support 102. This may pull the image medium 150 taut. That is, it has no distortions and flat. The tension in image medium 150 also helps secure image medium 150 to image medium couplers 140. The medium couplers 140 may be T shaped and have an upper flange configured to retain the image medium 150 to prevent image medium 150 from separating from foldable sections 104.

Figure 10:
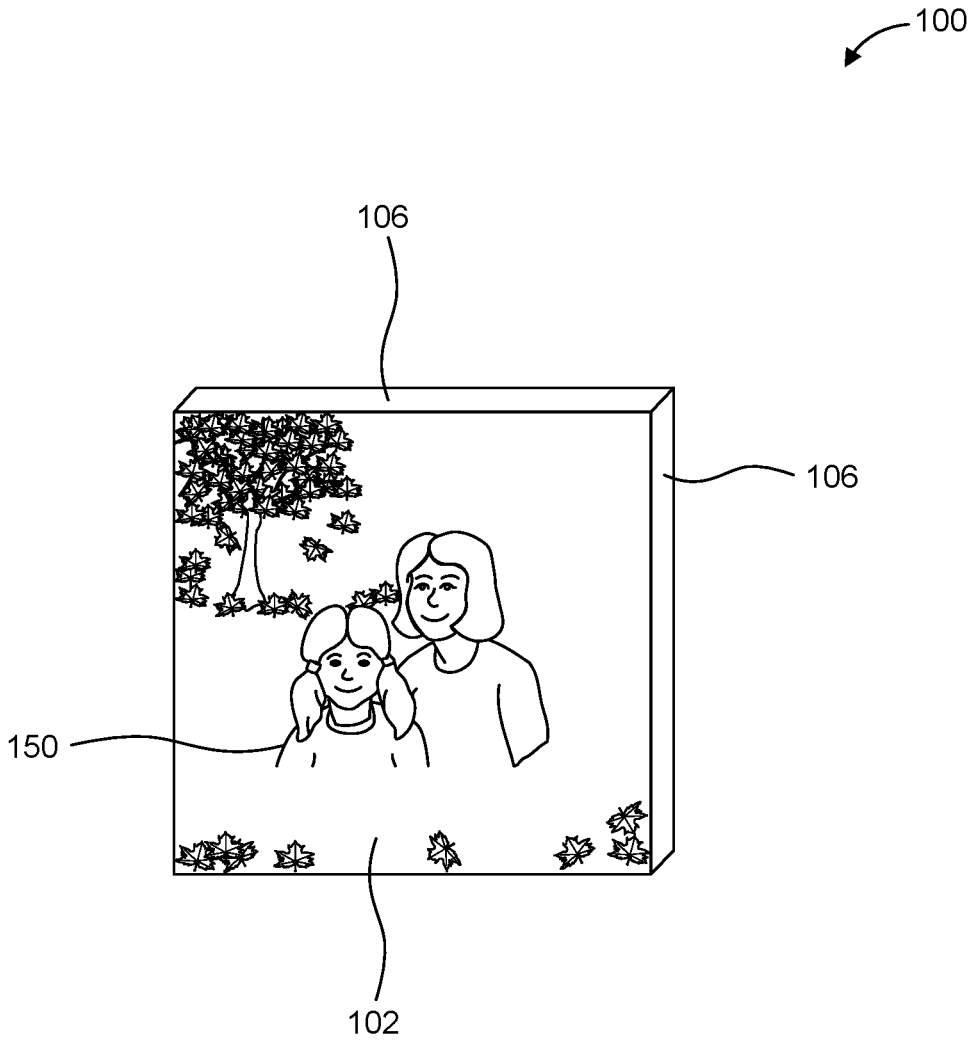
FIG. 10 shows a front perspective view of the image medium on the image display of FIG. 9 in the assembled configuration.

The dashed lines in FIG. 9 show foldable sections 104's location under image medium 150. In practice, foldable sections 104 would be obscured by image medium 150 but they are shown in FIG. 9 for clarity. FIG. 10 shows image display 100 from FIG. 9 in an assembled configuration. In the assembled configuration, foldable members are rotated around such that they are behind image support 102 (not shown). This gives image display 100 with image medium 150 a gallery wrap look.

In some embodiments, like those shown in FIGS. 9 and 10, image medium 150 may be coupled to image display 100 in the collapsed configuration. Image display 100 may be shipped with image medium 150 coupled thereto when the image display is in the collapsed configuration. In some embodiments, image medium 150 may be shipped separately from image medium 150. In some embodiments, image display 100 may be assembled from the collapsed state after shipping. Shipping image display 100 in the collapsed configuration can reduce shipping costs of image display 100 because the width of image display 100 is reduced.

In some embodiments, a vendor may offer custom gallery wraps for sale. The vendor may receive an image from a customer over the internet or at an in store kiosk. The vendor may print the image on image medium 150. Once printed, the vendor may located image medium 150 on image display 100. Image medium 150's voids 152 may be located such that they align with medium couplers 140. Once image medium 150 is located on image display 100, foldable sections 104 may be folded pulling image medium 150 taut. This method reduces the time the vendor needs to spend to produce the custom gallery wrap and improves quality and consistency. Additionally, using the foldable image display like those disclosed herein, allows the vendor to store multiple image displays in the store while taking up less space. This allows the vendor to make custom gallery wraps available for sale in little time.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The phraseology or terminology used herein is for the purpose of description and not limitation, such that the terminology or phraseology of the present specification is to be interpreted by the skilled artisan.

The breadth and scope of the present invention(s) should not be limited by any of the above-described exemplary embodiments, but should be defined only in accordance with the claims and their equivalents.

What is claimed is:

1. An image display comprising:

an image support section; and a plurality of foldable sections, each foldable section comprising:

a first segment rotatably coupled to and configured to lock with the image support section, a second segment rotatably coupled to and configured to lock with the first segment, and medium couplers extending from each second segment, each medium coupler having a stem and an upper flange configured to retain an image medium, wherein the image display has a first configuration and a second configuration, wherein the image support section, each first segment of the plurality of foldable sections, and each second segment of the plurality of foldable sections are coplanar in the first configuration, and wherein in the second configuration the image support section, each first segment of the plurality of foldable sections, and each second segment of the plurality of foldable sections are non-planar, each first segment of the plurality of foldable sections is locked to the image support section, and each second segment of the plurality of foldable sections is locked to a respective first segment of the plurality of foldable sections.

2. The image display of claim 1, wherein each first segment is perpendicular to the image support section and each second segment in the second configuration.

3. The image display of claim 2, wherein each first segment is rectangular and each second segment is trapezoidal.

4. The image display of claim 1, further comprising a lattice structure formed on the image support, the lattice structure configured to increase the rigidity of the image display assembly.

5. The image display of claim 1, wherein in the assembled configuration each first segment forms a snap fit connection with the image support and each second segment forms a snap fit connection with one of the first segments.

6. The image display of claim 1, wherein the image support and the plurality of foldable sections are formed by an injection molding process.

7. The image display of claim 1, further comprising an image medium, the image medium wrapping around the image support and foldable sections in the second configuration.

8. The image display of claim 7, wherein the image medium is taut in the second configuration.

9. The image display of claim 7, wherein the image medium is coupled to each second segment of the plurality of foldable sections.

10. The image display of claim 1, wherein the image support defines a void.

11. The image display of claim 1, wherein the first segment is rotatably coupled to the image support by a living hinge, and wherein the second segment is rotatably coupled to the first segment by a living hinge.

12. A image display comprising:

an image support section;

a plurality of foldable sections, each foldable section having a first segment rotatably coupled to and configured to lock with the image support section and a second segment rotatably coupled to and configured to lock with the first segment, and an image medium having a plurality of preformed voids formed therein and coupled to at least one of the image support section and one of the plurality of foldable section by medium couplers extending through then preformed voids;

wherein the image display has a first configuration and a second configuration, wherein the image support section, each first segment of the plurality of foldable sections, and each second segment of the plurality of foldable sections are co-planar in the first configuration, and wherein in the second configuration the image support section, each first segment of the plurality of foldable sections, and each second segment of the plurality of foldable sections are non-planar, each first segment of the plurality of foldable sections is locked to the image support section, and each second segment of the plurality of foldable sections is locked to a respective first segment of the plurality of foldable sections.

13. The image display of claim 12, wherein the image medium is coupled to each foldable section.

14. The image display of claim 12, wherein the image medium wraps around the display assembly when the first segments and second segments are locked.

15. The image display of claim 12, wherein each first segment and second segment are configured to lock using a snap fit connection.

16. The image display of claim 12, wherein the image medium is coupled to the at least one of the image support section and one of the plurality of foldable section without using an adhesive.

17. The image display of claim 12, further comprising:

wherein the image display has a collapsed configuration and an assembled configuration, wherein the first segment is locked with the image support and the second segment is locked with the first segment in the assembled configuration, and wherein a thickness of the image display in the collapsed configuration is less than half a thickness of the image display in the assembled configuration.

18. The image display of claim 12, wherein the medium couplers extend from the foldable sections.

19. The image display of claim 12, wherein the medium couplers extend from a coupling plate.

20. A method of assembling an image display comprising:

coupling an image medium to a plurality of foldable sections, each foldable section extending from an image support section, rotating each foldable section relative to the image support section, and rotatably locking each foldable section relative to the image support section, wherein the image medium has a plurality of preformed voids formed in the image medium, and wherein a medium coupler extends from each of the foldable sections and is configured to engage one of the voids of the image medium to couple the image medium to the foldable sections, and wherein the image display has a first configuration and a second configuration, wherein the image support section, each first segment of the plurality of foldable sections, and each second segment of the plurality of foldable sections are co-planar in the first configuration, and wherein in the second configuration the image support section, each first segment of the plurality of foldable sections, and each second segment of the plurality of foldable sections are non-planar, each first segment of the plurality of foldable sections is locked to the image support section, and each second segment of the plurality of foldable sections is locked to a respective first segment of the plurality of foldable sections.

* * * * *